United States Patent [19]

Molins et al.

[11] 4,283,187

[45] Aug. 11, 1981

[54] APPARATUS FOR FORMING COMPOSITE RODS

[75] Inventors: Desmond W. Molins; Michael J. Soborowski, both of London, England

[73] Assignee: Molins Limited, London, England

[21] Appl. No.: 900,003

[22] Filed: Apr. 25, 1978

[30] Foreign Application Priority Data

Apr. 30, 1977 [GB] United Kingdom ..... 18187/77

[51] Int. Cl.[3] ..... A24C 5/50

[52] U.S. Cl. ..... 493/48; 493/47; 493/349

[58] Field of Search ..... 93/77 FT, 1 C; 131/264, 131/94

[56] References Cited

U.S. PATENT DOCUMENTS

| | | | |
|---|---|---|---|
| 2,809,639 | 10/1957 | Edwards | 131/94 |
| 2,957,285 | 10/1960 | Molins | 53/28 |
| 2,963,026 | 12/1960 | Molins et al. | 131/94 |
| 2,990,831 | 7/1961 | Molins | 131/94 |
| 3,118,454 | 1/1964 | Rowlands | 131/94 |
| 3,267,820 | 8/1966 | Molins et al. | 93/1 C |
| 3,357,320 | 12/1967 | Sexstone et al. | 93/1 C |
| 3,365,046 | 1/1968 | Morris et al. | 198/25 |
| 4,093,496 | 6/1978 | Molins | 93/77 FT X |
| 4,103,596 | 8/1978 | Molins | 93/77 FT |

FOREIGN PATENT DOCUMENTS

| | | |
|---|---|---|
| 2527353 | 1/1976 | Fed. Rep. of Germany . |
| 1485131 | 9/1977 | United Kingdom . |

*Primary Examiner*—James F. Coan

*Attorney, Agent, or Firm*—Craig and Antonelli

[57] ABSTRACT

Successive groups of axially aligned component filter portions are separately united by one or more wrapper portions while moving axially. The composite filter rods formed from the groups are separate, so that there is no need for a continuous rod cut-off. Composite filters, for attachment to cigarette lengths, are subsequently obtained from the rods by cutting at appropriate positions.

18 Claims, 13 Drawing Figures

Figure 3:
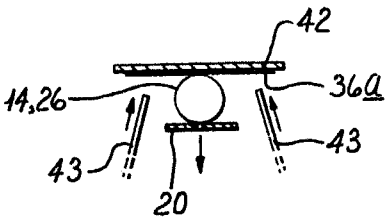

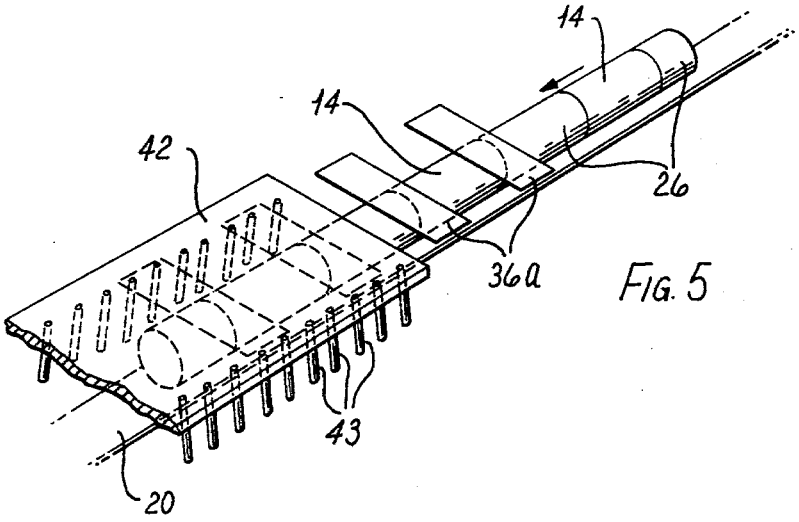
FIG. 5
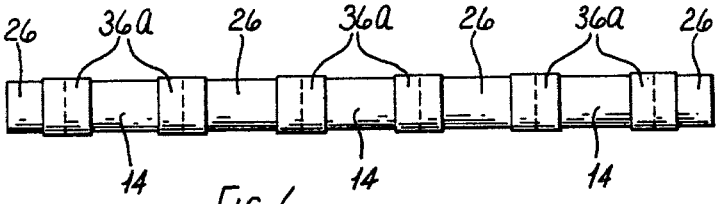
FIG. 6
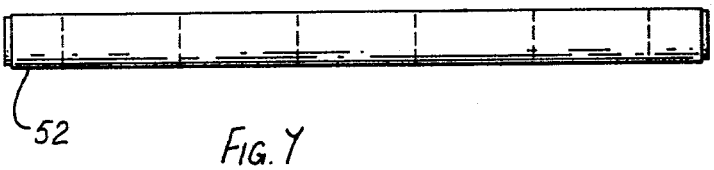
FIG. 7
FIG. 11
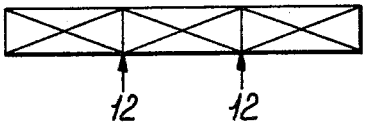
FIG. 12
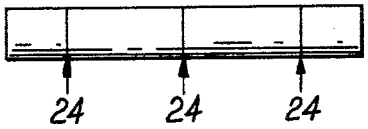
FIG. 13
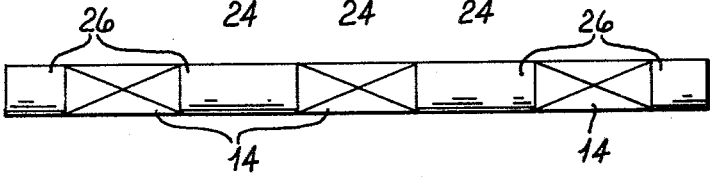

APPARATUS FOR FORMING COMPOSITE RODS

This invention relates to apparatus for forming composite rods, particularly mouthpiece or filter rods from which composite mouthpieces, for incorporation in cigarettes, can be obtained by cutting the rods at appropriate positions.

It is common for cigarettes to consist of a tobacco filler portion and an adjoining mouthpiece portion. Cigarettes of this type are herein referred to as "filter cigarettes" and mouthpieces are referred to as "filters". Such references are not intended to exclude from the scope of the present disclosure mouthpieces which do not have a filtering action. For example, a mouthpiece or part of a mouthpiece may comprise a tube.

Composite filters are known in which each filter comprises two or more axially adjacent portions of different filter materials. For example, a common construction of a composite (dual) filter has a portion consisting of a plug of paper-like material such as myria or dico and a portion consisting of a tow of fibrous cellulose acetate or other suitable fibrous material.

It is already known to form a composite filter rod by assembling filter portions of different material in an alternating stream and continuously feeding the stream into the garniture of a continuous rod filter making machine where it is enclosed in a continuous wrapper web. U.S. patent application Ser. No. 808,366, now U.S. Pat. No. 4,103,596, is concerned with forming composite filter rods by rolling spaced uniting bands around groups of component filter portions.

According to one aspect of the present invention apparatus for forming composite filter rods comprises conveyor means for moving a stream of axially aligned component filter portions in predetermined sequence on an axial path; means for assembling predetermined groups of filter portions from said stream; means for feeding said groups forward at predetermined intervals; means for conveying a continuous wrapper; means for severing said wrapper into separate wrapper portions; means synchronised with said feeding means for applying at least one wrapper portion while said group is being conveyed axially so that each of the junctions between component portions of a group is spanned by a wrapper portion; and means for wrapping and sealing said wrapper portion or portions around said group to unite it into an individual composite filter rod while moving in an axial direction.

Groups of component filter portions are preferably assembled on a conveyor, as disclosed for example in U.S. Pat. No. 3,131,612, and are closed up into abutment either by feeding the groups forward at timed intervals at a speed higher than that of the assembly conveyor or by retarding successive leading components as described in U.S. Pat. No. 3,059,651 or U.S. patent application Ser. No. 815,199 or 815,197.

The wrapper portions may be cut and spaced from the continuous wrapper web, which may be pre-pasted with an adhesive, in accordance with the disclosure of U.S. Pat. No. 2,963,026. Air jets cooperating with a guide surface may be provided to control the wrapper portions after application to the groups but before they are wrapped around the components. In this way the portions may be carried by the groups in a flattened position and making contact with the groups approximately at a tangent. Initial folding of a wrapper portion around adjacent component portions of a group may be performed with the aid of a driven wheel having a shaped periphery, the axis of rotation of the wheel being substantially perpendicular to the path of the group.

After initial folding the groups may pass into a conventional garniture where the wrapper portions are fully wrapped and sealed around the junctions between component portions of the groups. Individual rods thus formed may be separated and delivered to a transverse catcher drum in accordance with the disclosure of U.S. Pat. No. 3,365,046, or as disclosed in U.S. Pat. No. 4,103,596.

Another aspect of the present invention provides apparatus for forming composite filter rods comprising a first conveyor for moving a group of axially-aligned component filter portions in an axial direction; a second conveyor provided with spaced abutments and arranged to receive a group from the first conveyor between successive leading and trailing abutments and to convey it in an axial direction; retarding means for slowing the articles of a group relative to the second conveyor so that they are engaged by said trailing abutment; and means synchronised with said second conveyor for applying at least one wrapper portion, while said group is being conveyed axially by the second conveyor, so that each of the junctions between component portions of a group is spanned by a wrapper portion. Preferably the first conveyor is arranged to move faster than the second conveyor so that the groups of component filter portions are closed up by abutment with the leading abutment as they are transferred to the second conveyor. The retarding means may comprise a stationary surface onto which the groups are delivered by the first or second conveyor. The surface may be provided with suction to increase the braking effect, and may also be shaped into a channel to control and align the components of the group. Separate wrapper portions could be applied to each junction between components or wrapper bands which span one or more components could be used. If a single wrapper portion is used to unite the whole group this is preferably somewhat shorter than the average length of a group so that it cannot extend beyond the end component if slight variations in component length cause a group of below average length to be assembled.

A further aspect of the invention provides apparatus for forming composite filter rods, comprising conveyor means for moving a stream of axially aligned component filter portions in predetermined sequence on an axial path; timing means for feeding said stream forward at a predetermined rate; means for conveying a continuous wrapper; means for cutting and spacing said wrapper into separate spaced wrapper portions; means synchronised with said timing means for applying said spaced wrapper portions to said stream, so that each wrapper portion spans at least three successive junctions between component filter portions and successive wrapper portions are separated by a gap including the junction between predetermined successive component filter portions; and means for wrapping and sealing the wrapper portions around the component filter portions whereby individual composite filter rods each comprising not less than four component filter portions united by a single wrapper portion are delivered axially on said path.

Figure 4:
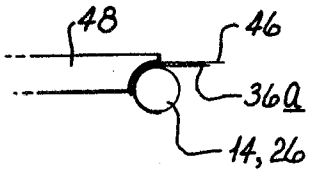
Figure 1:
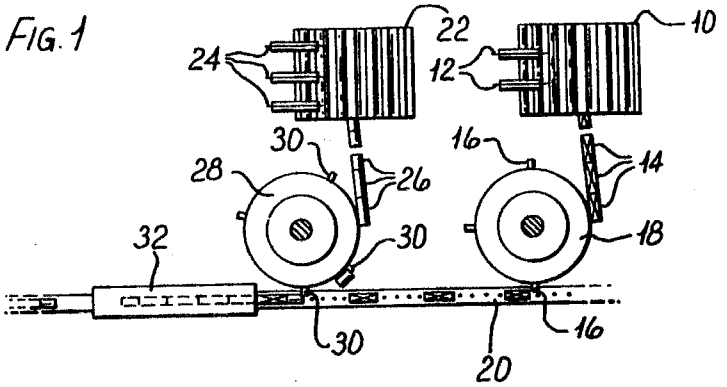
Figure 2:
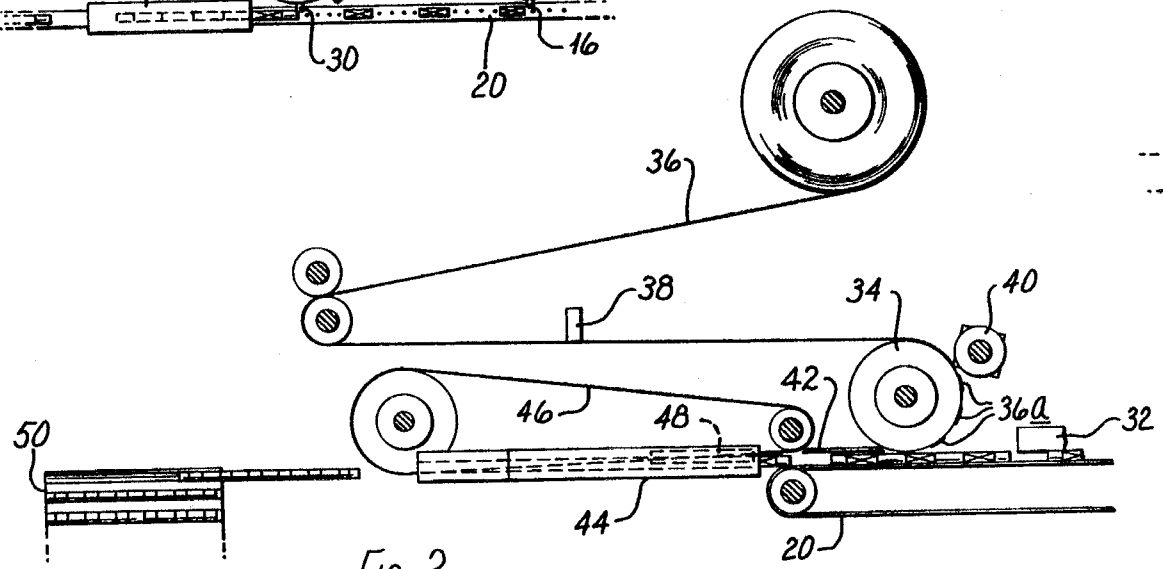
Figure 9:
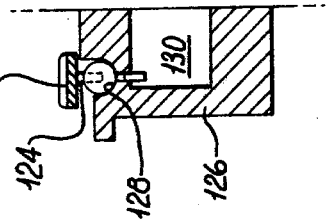
Figure 10:
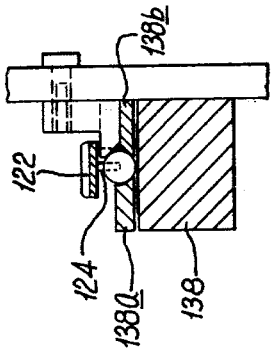
Figure 8:
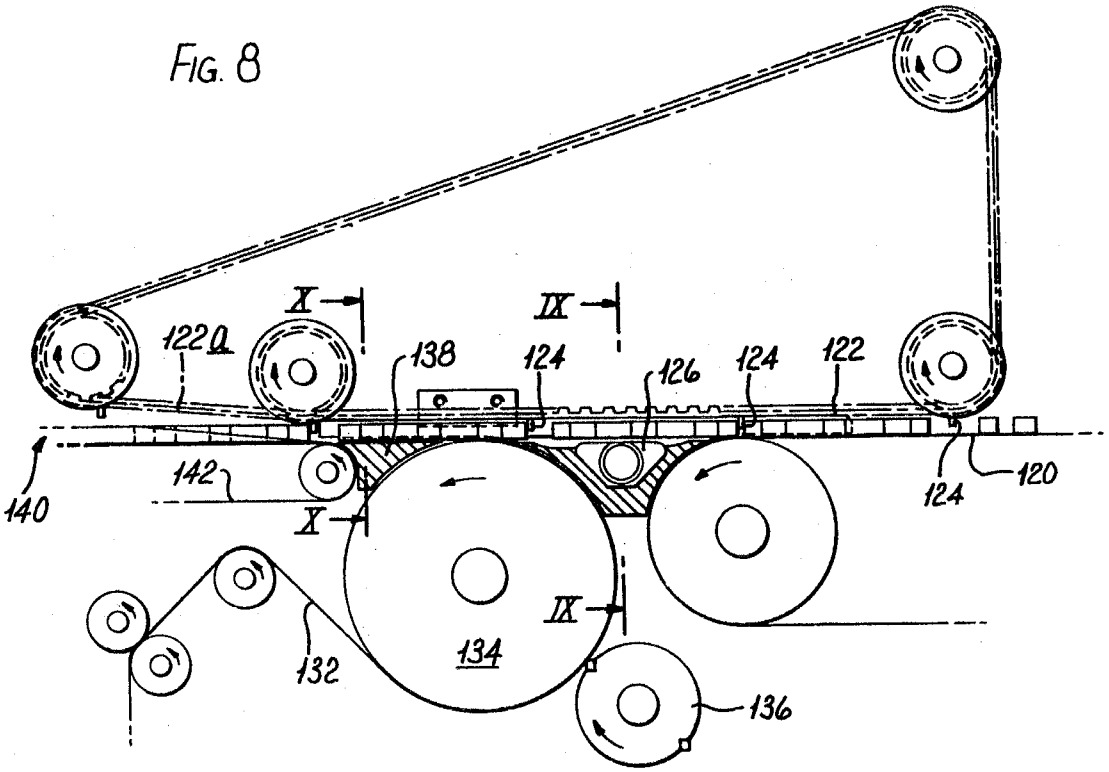

The invention will now be further described, by way of example only, with reference to the accompanying diagrammatic drawings, in which:

FIG. 1 is a plan view of part of an apparatus for producing composite filter rods, FIG. 2 is a side view of another part of the apparatus of FIG. 1, FIGS. 3 and 4 are detail sectional views of parts of the apparatus of FIG. 1, FIG. 5 is a detail perspective view of part of the apparatus of FIG. 1, FIG. 6 is a side view of a composite filter rod, FIG. 7 is a side view of another composite filter rod, FIG. 8 is a side view of part of a modified apparatus for producing composite filter rods, FIG. 9 is a sectional view on the line IX—IX of FIG. 8, FIG. 10 is a sectional view on the line X—X of FIG. 8, FIG. 11 shows the component filter portions produced from a rod length of one type of filter material, FIG. 12 shows the component filter portions produced from a rod length of another type of filter material, and FIG. 13 shows an assembled group of component filter portions for forming into a composite filter rod.

Referring to FIG. 1, a fluted drum 10 is arranged to receive rod lengths of a first type of filter material from a hopper (not shown) positioned above the drum. Rotary cutting knives 12 are provided at axially spaced positions to sub-divide the rod lengths into first component filter portions 14 as the lengths are conveyed in the flutes of drum 10. The filter portions 14 are fed out of their flute by means of a conveyor (not shown) carrying pusher members which pass obliquely through successive flutes so as to form a line of endwise-moving portions. Each successive leading filter portion is pushed up out of line (by means not shown) so as to expose its rear face for engagement by a pusher 16 carried by a rotatable turntable or disc 18. The pusher 16 accelerates the filter portion and conveys it onto a suction conveyor 20.

A similar arrangement is provided, downstream relative to the conveyor 20, for feeding rod lengths of a second type of filter material. Thus a fluted drum 22, knives 24, and conveyor (not shown) cooperate to supply a line of second component filter portions 26 to a disc 28 having pushers 30 which supply the filter portions 26 to the suction conveyor 20.

The two filter portion feeding devices associated with the drums 10, 22 are arranged to feed the first and second component filter portions 14, 26 onto the conveyor 20 so that in general they alternate with each other and are somewhat spaced apart. The apparatus thus far described may be similar to that described and illustrated in U.S. Pat. No. 3,131,612, to which reference is directed for further details. The apparatus could also be constructed in accordance with the disclosure of U.S. patent application Ser. No. 815,197 to which reference is also directed.

The first filter rod lengths, supplied to the drum 10, may be of cellulose acetate fibres, whereas the second filter rod lengths, supplied to the drum 22 may be of myria, dico, or other paper-like material. The division of each first rod length into first component filter portions 14 by means of knives 12 is indicated in FIG. 11. The division of each second rod length into second component filter portions 26 by means of knives 24 is indicated in FIG. 12. It should be noted that the first filter rod lengths are divided into three equal portions and the second filter rod lengths are divided into two unit length portions and two end half portions.

The component filter portions 14 are intercalated with the portions 26 to form a group on the conveyor 20. Each group comprises a leading portion which is a half unit length portion 26, followed by alternating unit length portions 14 and 26, and a trailing portion which consists of the other half unit length portion 26. A group in which the spaces between portions have been closed up is shown in FIG. 13. A group is not restricted to the arrangement shown in FIG. 13: the first and second filter rods could be divided in different ways to produce different combinations of alternating components. Furthermore, a group similar to that of FIG. 13 can be produced in other ways. In particular, the cutting knives 24 could be arranged so that the two half unit length portions of each second filter rod lie adjacent one another: an arrangement for producing groups of component filter portions in this way is described and illustrated in U.S. patent application Ser. No. 815,197.

Each group is delivered by the suction conveyor 20, to the left as viewed in FIG. 1, towards the part of the apparatus shown in FIG. 2, which part forms the group into a composite filter rod. Each composite filter rod is divided to produce individual composite filters comprising half portions of the first and second filter materials: this is why each group has a half portion at its ends. In order that correctly formed groups are supplied by the conveyor 20, the relative timing of the delivery from the drums 10, 22 should allow the adjacent half portions 26 from successive rods carried by drum 22 to be deposited on the conveyor 20 without any portions 14 occupying the space between them.

Each group is closed up into a substantially abutting line of components on the conveyor 20 by means of retarding means which frictionally retards the successive leading components of the groups. The retarding means, indicated generally at 32 in FIGS. 1 and 2, could comprise a cam-operated braking member such as that disclosed in U.S. Pat. No. 3,059,651 or in U.S. patent application Ser. No. 815,197 or a suction retarding means as disclosed in U.S. patent applications Ser. Nos. 815,199 and 815,197. The retarding means 32 may be timed so that groups are released for further conveyance by conveyor 20 at timed intervals, or it may merely retard the groups on the conveyor so that the pusher 30, moving faster than conveyor 20, can act as the means for timing each group by conveying the group relative to the conveyor 20 up to a predetermined release position. For this purpose one or more of the pushers 30 could be retractable relative to the turntable 28 so that the release point can be more accurately controlled. Retractable pushers or fingers are disclosed in U.S. Pat. No. 2,809,639.

Referring now to FIG. 2 a group of abutted component filter portions is conveyed by the conveyor 20 from the retarding means 32 under a suction cutting drum 34. A web 36 of wrapper material, which is prepasted at 38, is supplied to the drum 34 at a controlled speed and is severed into uniting bands 36*a* by means of a rotary knife 40. The uniting bands 36*a* cut from web 36 become spaced apart on the drum 34 as a result of the difference in speed of the web and drum. Further details of a cutting and spacing operation on a suction drum are contained in U.S. Pat. No. 2,963,026.

The retarding means 32 and conveyor 20 and the rotary knife 40 and drum 34 are so synchronised that the uniting bands 36*a* are applied over the junctions between component portions of a group as the group is conveyed underneath the suction drum. The uniting bands are subsequently carried with the group, being stuck onto the upper surface by means of the adhesive applied to the web at 38. As shown particularly in FIGS. 3 and 5 the group 14, 26 is conveyed underneath a plate 42 and past cooperating nozzles 43 through which streams of air may be supplied. The action of the nozzle 43 on the uniting bands 36*a* carried by the groups is to maintain the bands flat against the plate 42 until the group moves into the garniture 44 where controlled wrapping of each band around its associated junction takes place.

In the garniture 44 the groups are carried by a suction garniture tape 46 (inverted) and the bands 36*a* are progressively wrapped around the adjacent component portions. The garniture 44 also includes a heater for setting the adhesive on each band 36*a*. Whilst it would be possible to use conventional stationary folders in the garniture these could cause problems since each band 36*a* has a leading edge which must be correctly folded. Such problems can be avoided by using a shaped wheel 48 (FIGS. 2, 4) which backs and is driven by the garniture tape 46, and which gives initial curvature to the bands 36*a*.

In the garniture 44 each group is formed into an individual composite filter rod, as shown in FIG. 6. Successive rods are separated and fed onto a catcher drum 50, by means (not shown) such as a spiral spacer as described and illustrated in U.S. Pat. No. 3,365,046.

Instead of joining a group of component filter portions by means of uniting bands associated with each junction fewer uniting bands could be used. In particular a single uniting band could be used and in this case it is preferable for the band to have an overall length somewhat less than that of an average group. In this way the wrapper will never be longer than a group even allowing for build-up of the inevitable slight length variations of the component filter portions of the group. This is important since an end component portion recessed inside a wrapper is unacceptable, whereas a wrapper not spanning the whole length of a group is perfectly acceptable. A composite filter rod having a single uniting band or wrapper 52 is shown in FIG. 7. This rod can be produced by the apparatus of FIGS. 1 and 2 by appropriate adjustment of the spacing and timing of rotary knife 40 and suction drum 34.

Instead of using retarding means 32 to produce separated groups for delivery into the garniture, a continuous line of abutting components may be fed into the garniture, as with conventional rod-making machines (see e.g. U.S. Pat. No. 3,131,612). Non-continuous wrapper is still applied in the garniture so that separate rods are formed from each group, the rods abutting on exit from the garniture. The rods are separated and fed onto a catcher drum by means such as that disclosed in U.S. Pat. No. 3,365,046. The finger 30 which conveys the trailing component of a group could act as the timing member for delivering the continuous rod line into the garniture: as before this finger could be retractable.

A further modified arrangement for delivering groups of component filter portions into the garniture is shown in FIGS. 8, 9 and 10. Component filter portions are assembled on a conveyor 120 in the same way as on the conveyor 20 of FIG. 1. An upper timing band 122 carrying regularly spaced pins 124 is arranged so that the leading component of each group is brought into abutment with a pin 124, the speed of conveyor 120 being greater than that of band 122. The timing and relative speeds of conveyor 120 and band 122 are such that the components of successive groups move into abutment on the conveyor 120 behind successive pins 124. Subsequently the group passes onto a bridge 126 having a concave guide channel 128 to which suction is applied from a chamber 130. The group is retarded on the bridge and is aligned in the guide channel 128 prior to being further conveyed by engagement of the trailing component of the group by the following pin 124.

A web 132 of wrapper material is delivered to a suction drum 134 arranged downstream of the bridge 126. As before, the web 132 is delivered at a controlled speed and is severed by a rotary knife 136 into uniting bands which become spaced on the drum 134. The uniting bands, which are pre-pasted, are applied to the group and are carried with the group over another bridge 138. Side pieces 138*a*, 138*b* (FIG. 10) above the bridge 138 impart a curvature to the uniting bands prior to entry into the garniture 140: this could be allowed to flatten slightly on entry to the garniture. The garniture includes a garniture tape 142 running at the same speed as band 122. Once the group is deposited on the garniture tape 142 the pin 124 is gradually withdrawn as a result of the inclined run 122*a* of band 122.

The assembly and delivery of groups of component filter portions using a band provided with pins has the advantage that there is no difficulty with subsequent timing should there be a component missing from a group, since the apparatus will merely produce a short assembly which can easily be rejected. In apparatus where the timing relies on continuous rod abutment of components all subsequent assemblies would be affected by a single missing component. Moreover, since the components of each group are first positively retarded and then conveyed by the pins, there should be no possibility of gaps between components. In addition, there should be no build-up of error due to inaccurate lengths of component portions. Where such inaccuracies still cause problems the maximum acceptable length of a group could be preselected and the spacings between component portions adjusted as necessary so that all groups are of said maximum length.

As an alternative to the use of bridges 126, 138, the band 122 could be provided with suction to carry the groups from the conveyor 120 to the garniture tape 142. There would then be no movement of the groups relative to the band 122 after they had been closed up against a pin 124 on delivery from the conveyor 120.

We claim:

1. Apparatus for forming composite filter rods, comprising conveyor means for moving a stream of axially aligned component filter portions in predetermined sequence on an axial path; means for assembling predetermined groups of filter portions from said stream; means for feeding said groups of filter portions forward at predetermined intervals; means for conveying a continuous wrapper; means for severing said wrapper into separate wrapper portions; means synchronised with said feeding means for applying at least one wrapper portion while one group of said predetermined groups of filter portions is being conveyed axially so that each of the junctions between component portions of a group of filter portions is spanned by a wrapper portion; and means for wrapping and sealing said at least one wrapper portion around said group of filter portions to unite it into a composite filter rod, said severing and applying means being arranged so that no wrapper portion spans more than one of said groups so that said groups are converted into a series of separate composite filter rods while moving in an axial direction.

2. Apparatus according to claim 1, wherein the means for assembling predetermined groups of filter portions includes means for retarding component filter portions relative to said conveyor means.

3. Apparatus according to claim 2, wherein said means for assembling predetermined groups of filter portions and said means for feeding groups of filter portions forward at predetermined intervals comprise means for retarding selected component filter portions for a predetermined period and thereafter releasing said selected component filter portions for conveyance by said conveyor means.

4. Apparatus according to claim 1, further including guide means and air jet means for controlling said wrapper portions between said applying means and said wrapping and sealing means.

5. Apparatus according to one of claims 1 or 4, wherein said wrapping and sealing means includes a driven wheel arranged with its axis of rotation substantially perpendicular to said path, said wheel having a shaped periphery for initial folding a wrapper portion around the component filter portions of a group of filter portions.

6. Apparatus according to claim 1, wherein said means for assembling groups and said means for feeding groups of filter portions forward at predetermined intervals includes pusher means for conveying component filter portions forward on said path at a higher speed than said conveyor means.

7. Apparatus according to claim 1, wherein said means for applying wrapper portions includes means for spacing at least two adjacent wrapper portions apart for application to a single group.

8. Apparatus for forming composite filter rods, comprising conveyor means for moving a stream of axially aligned component filter portions in predetermined sequence on an axial path; means for assemblying predetermined groups of filter portions from said stream including means for retarding component filter portions relative to said conveyor means, said retarding means comprises an endless conveyor having a run parallel to said path and carrying spaced abutments for retarding component filter portions on said path; means for feeding said groups of filter portions forwarded at predetermined intervals; means for conveying a continuous wrapper; means for severing said wrapper into separate wrapper portions; means synchronized with said feeding means for applying at least one wrapper portion while one group of said predetermined groups of filter portions is being conveyed axially so that each of the junctions between component portions of a group of filter portions is spanned by a wrapper portion; and means for wrapping and sealing the at least one wrapper portion around said group of filter portions to unite it into an individual composite filter rod while moving in an axial direction.

9. Apparatus according to claim 8, comprising further retarding means for retarding groups of components filter portions relative to said endless conveyor, wherein said means for feeding said groups of filter portions forward at predetermined intervals includes said endless conveyor and spaced abutments.

10. Apparatus for forming composite filter rods comprising a first conveyor for moving a group of axially-aligned component filter portions in an axial direction; a second conveyor provided with spaced abutments and arranged to receive a group of axially aligned component filter portions from the first conveyor between successive leading and trailing abutments and to convey it in an axial direction; retarding means for slowing the component filter portions of a group of axially aligned component filter portions relative to the second conveyor so that they are engaged by said trailing abutment; and means synchronized with the second conveyor for applying at least one wrapper portion, while said group of axially aligned component filter portions is being conveyed axially by the second conveyor, so that each of the junctions between component filter portions of a group of axially aligned component filter portions is spanned by a wrapper portion and no wrapper portion extends between groups, so that said groups are converted into a series of separate composite filter rods.

11. Apparatus according to claim 10, wherein said leading abutment is arranged to engage the leading component filter portion of a group of axially aligned component filter portions received from the first conveyor and retard it to close up the component portions of the group.

12. Apparatus according to claim 10, wherein the retarding means comprises a stationary guide surface onto which the groups of axially aligned component filter portions are delivered.

13. Apparatus according to claim 12, including means for applying suction to said stationary guide surface to increase its retarding effect.

14. Apparatus for forming composite filter rods, comprising conveyor means for moving a stream of axially aligned component filter portions in predetermined sequence on an axial path; timing means for feeding said stream of axially aligned component filter portions forward at a predetermined rate; means for conveying a continuous wrapper; means for cutting and spacing said wrapper into separate spaced wrapper portions; means synchronised with said timing means for applying said spaced wrapper portions to said stream of axially aligned component filter portions, so that each wrapper portion spans at least three successive junctions between component filter portions and successive wrapper portions are separated by a gap including the junction between predetermined successive component filter portions; and means for wrapping and sealing the wrapper portions around the component filter portions whereby individual composite filter rods each comprising not less than four component filter portions united by a single wrapper portions are delivered axially on said path.

15. Apparatus according to claim 14, wherein said conveyor means and said timing means are arranged to deliver a substantially continuous stream of component filter portions on said path.

16. Apparatus according to claim 14, including means for assembling said stream of axially aligned component filter portions into groups of component filter portions prior to the application of a wrapper portion to each group.

17. An apparatus for forming composite rods, the apparatus comprising means for feeding a stream of rod-like articles in an axial direction, means for feeding a continuous wrapper, means for severing the continuous wrapper into sections and for spacing the sections apart in a continuously moving stream, means for receiving said stream of rod-like articles and said stream of spaced wrapper sections and for conveying them together in the axial direction, and means for wrapping and uniting each wrapper section around at least end portions of successive rod-like articles in said stream of rod-like articles, said respective streams of articles and wrapper sections being received in a specific relationship such that predetermined junctions between adjacent articles of the stream of rod-like articles are not spanned and united by a wrapper section so that a series of individually axially moving composite rods is produced.

18. An apparatus according to claim 17, wherein said severing and spacing means is arranged to produce a regular series of wrapper section of sufficient length to completely overlap at least one rod-like article in said stream of rod-like articles so that each composite rod comprises at least three articles.

* * * * *